US005989001A

United States Patent [19]

Eisenmann

[11] Patent Number: 5,989,001

[45] Date of Patent: Nov. 23, 1999

[54] PLANETARY ROTATION MACHINE WITH HYDROSTATICALLY MOUNTED CONTROL PART, AND CONTROL PART FOR THIS PURPOSE

[76] Inventor: Siegfried Eisenmann, Conchesstrasse 23, 88326 Aulendorf, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/702,085

[22] Filed: Aug. 24, 1996

[30] Foreign Application Priority Data

Sep. 8, 1995 [EP] European Pat. Off. ..... 95114072

[51] Int. Cl.[6] ..... F01C 1/10

[52] U.S. Cl. ..... 418/61.3

[58] Field of Search ..... 418/61.3

[56] References Cited

U.S. PATENT DOCUMENTS 4,159,723 7/1979 Baatrup et al. ..... 418/61.3
4,411,607 10/1983 Wusthof et al. ..... 418/61.3
4,699,577 10/1987 Dlugokecki et al. ..... 418/61.3

FOREIGN PATENT DOCUMENTS 0367046 5/1990 European Pat. Off. .
3030203 2/1982 Germany ..... 418/61.3
3402710 8/1985 Germany .

*Primary Examiner*—John J. Vrablik

[57] ABSTRACT

A hydrostatic bearing mounts a rotatable control part of a planetary rotation machine according to the orbital principle. Pockets are arranged at least in one sliding surface. Each pocket is surrounded by a bearing gap and fed with bearing fluid by a supply line under pressure. The bearing gap is small, so that there is only a small flow of bearing fluid from the pocket. The supply line, the feed with bearing fluid and the bearing gap are designed so that the pressure required for a rigid bearing can be built up in the pocket. Using the working fluid at half the high pressure in the bearing pocket results in a bearing which has minimal leakage and frictional losses and can be realized at low cost, so that the efficiency of the planetary rotation machine as a whole is increased.

11 Claims, 3 Drawing Sheets

Fig. 2
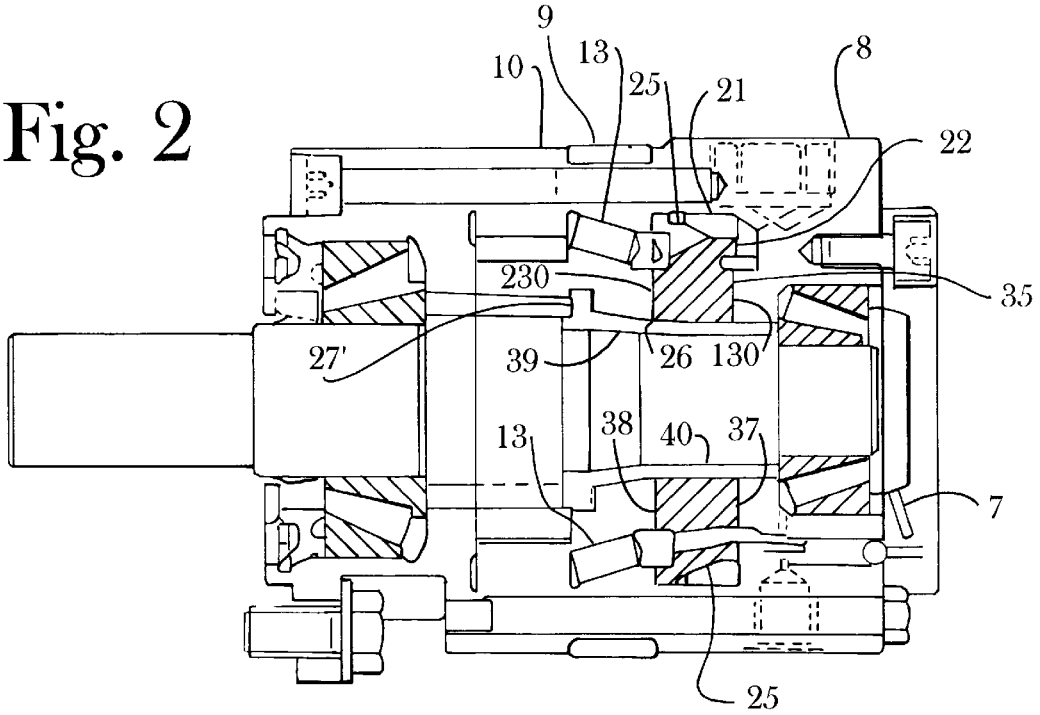
Fig. 3A
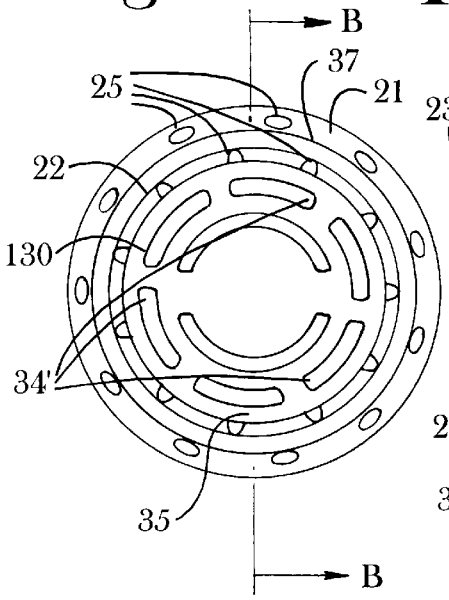
Fig. 3B
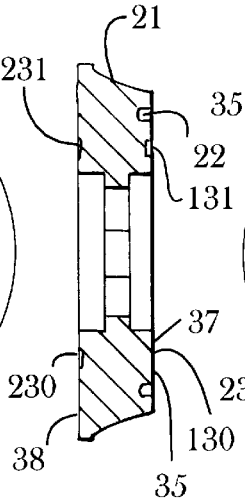
Fig. 3C
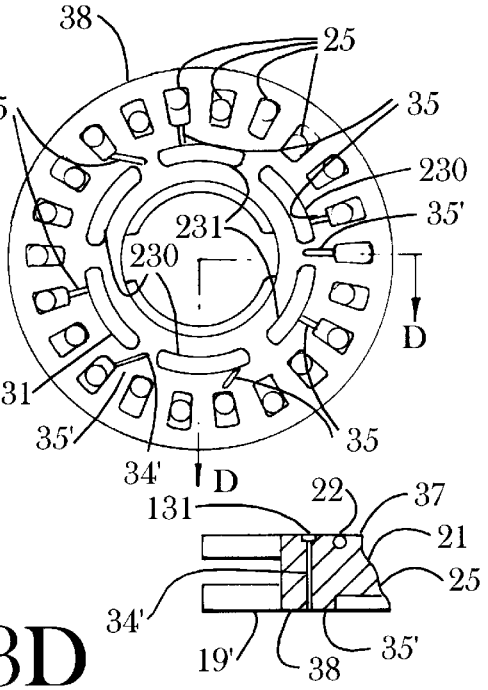
Fig. 3D

PLANETARY ROTATION MACHINE WITH HYDROSTATICALLY MOUNTED CONTROL PART, AND CONTROL PART FOR THIS PURPOSE

BACKGROUND OF THE INVENTION

1. Field of the Invention

The invention relates to a planetary rotation machine having a displacer part acting as a drive part or power take-off part and a control part that serves for supplying working fluid to, and removing working fluid from, the displacer part and rotates relative to at least one adjacent bearing part about an axis of rotation of the control part. The displacer part has a stationary outer part with an inner tooth system that interacts with an outer tooth system of a rotatable, eccentrically arranged rotary piston. Transmission means are provided that transmit the rotary velocity of the rotary piston about its own axis with the same torque to a drive shaft or power take-off shaft. The invention also relates to a control part with a slide bearing for such a planetary rotation machine. These planetary rotation machines preferably operate as low-speed machines with high thrust according to the so-called orbit principle. Hydrostatic, in particular oil-operated, planetary rotation machines are primarily meant. However, the invention can also be applied in the case of machines which are operated with a compressible working medium, in particular with compressed air.

2. Discussion of Relevant Art

For controlled feed of the working fluid in the displacer part, these machines have rotary valves or rotating control parts which revolve at the speed of the rotor or planetary piston. A control part comprises essentially two annular channels which are open to the outside towards a contact region. The high pressure side of the two working fluid connections is connected to one channel, and the low pressure side to the other. In the control part, connections extend alternately from the two annular channels into a common connection region, from which connecting lines lead through a connection part to the displacer part. The annular channels and the connection region are in sliding contact with the connecting lines or with contact surfaces in which the line connections are arranged. The transport of working fluid in as leak-free a manner as possible under pressure between parts moving relative to one another or through sliding bearings requires distances as small as possible between the sliding surfaces. However, the distances may not be so small that high frictional losses and in particular considerable wear result. It has been found that the total losses of planetary rotation machines are due to a large extent to the losses at the rotating control parts.

In general, spool or disc valves are used as control parts. The sliding connection regions and the annular channels are arranged at cylindrical lateral surfaces in the case of spool valves and at least the majority of them are arranged at the flat side surfaces normal to the axis of rotation of the control part in the case of disc valves. If necessary, an annular channel may be formed along the cylindrical lateral surface also in the case of disc valves. The alternating connections to the common connection region preferably lead through the disc and are thus not arranged in the region of the sliding bearing.

In the rotating state at high speeds, the spool valves have a relatively high resistance to flow owing to the associated increase in the turbulence of the fluid flowing through the channels and connections. Preferably, mounting is effected by means of the cylindrical spool outer surface sliding against a cylindrical inner surface of a housing part. If the so-called port-to-port leaks are kept small, the play in the housing must be extremely small, preferably less than 0.5 per mil of the spool diameter. Since the cylinder surface interrupted by channels does not have good properties as a sliding bearing, wall contact cannot be avoided. As a result of wear and erosion, the play increases very rapidly during operation, so that the channel leaks and also the drainage leaks into the machine interior increase rapidly.

In the case of disc valves, the flat disc end surfaces must be mounted optimally and without leaks and friction. The requirement for the radial mounting and for the cylinder lateral surface depends on whether annular channels and sliding connections are to be provided thereto. Since, however, the alternating connections to the common connection region are not in the region of the cylinder lateral surface, better sliding bearing properties can be achieved even when radial outer mounting is envisaged than in the case of conventional spool valves. In order to achieve better efficiency and a longer service life at high operating pressures, disc valves are increasingly being used. In an expedient embodiment of the connections, the disc valves have a smaller flow resistance compared with the spool valves.

In the case of disc valves, it is possible to achieve minimum play and compensation of wear by adjusting an axially adjacent part. Wear is compensated by providing, for example, a compensation piston which, in both directions of rotation, presses the disc valve without play against the connection part with the connecting lines to the displacer part. However, relatively high undesired frictional losses occur, amounting to as much as 12 percent of the theoretical torque. In addition, the losses are of different magnitudes in the forward and backward directions.

The known control parts are hydrodynamically mounted, that is to say the friction is high particularly during start-up of the planetary rotation machine. In the operating state, a lubricating layer forms in the bearing. In the event of vibrations due to variable loads or due to movement of the planetary piston, direct contacts between the sliding surfaces occur in spite of the lubricating layer in the bearing.

It has been found that an unexpectedly large part of the power loss of the planetary rotation machines is accounted for by the rotating control parts which, in accordance with their formation, are designated as spool or disc valves.

SUMMARY OF THE INVENTION

The object according to the invention is to develop the planetary rotation machine with the rotating control parts in such a way that the leakage and frictional losses are substantially decreased.

In a first inventive step, it is recognized that a hydrostatic bearing must be provided for mounting the rotatable control part. Pressurized bearing fluid which can flow away into a low-pressure region must thus be introduced, at least in hydrostatic bearing regions, between at least one first sliding surface of the control part and an adjacent second sliding surface of the bearing part. For this purpose, at least one pocket in the form of an indentation is provided at least in one sliding surface. Each pocket is surrounded by a bearing web and fed with bearing fluid through a feed line under pressure. An outlet gap is formed around the pocket, between the bearing web and the sliding surface opposite this. The outlet gap is very small so that there is only a small flow of bearing liquid from the pocket to a low-pressure region. The feed line, the feed with bearing fluid and the outlet gap or the bearing gap and the width of the webs are designed in such a way that the pressure required for rigid mounting can be built up in the pocket.

In the case of radial hydrostatic mounting, the bearing gap or outflow gap is in the range from 0.1 to 0.5, preferably from 0.25 to 0.35, per mil of the diameter of the hydrostatic bearing. In the case of axial hydrostatic mounting, the outflow gap from the pocket is in the range from 0.2 to 1.2, preferably from 0.4 to 1.0, in particular from 0.6 to 0.8, per mil of the axial thickness of the control part.

In order satisfactorily to mount the entire sliding surface by means of the hydrostatic bearing, at least two, but preferably at least three, pockets, in particular as a pocket set, are symmetrically arranged with respect to the axis of rotation of the control part. The pockets are elongated preferably in the circumferential direction and/or optionally radially and/or optionally axially and result in optimal isotropic rigidity of the hydrostatic bearing.

The hydrostatic bearing has the advantage that direct contact between the sliding surfaces and associated friction and wear are avoided even in the case of an extremely small bearing gap, owing to the high rigidity ensured by a sufficiently high bearing fluid pressure and by a sufficiently large hydrostatic bearing region. Owing to the minimal distance between the sliding surfaces, the leakage losses of the working fluid during entry into and exit from the control part are minimal. The rigidity and load-bearing capacity of a hydrostatic bearing depend not on the rotational speed but only on the supply pressure and on the size of the effective surfaces of the pockets. Even in the start-up phase, the hydrostatic bearing ensures friction-free rotation of the control part. Owing to the high bearing rigidity, there are no direct contacts between the sliding surfaces even in the case of vibrations.

The hydrostatic bearing can be used both for a radial bearing between cylindrical sliding surfaces and for an axial bearing between flat sliding surfaces normal to the axis of rotation of the control part. In other words, the hydrostatic bearing can be used both for the external mounting of spool valves and for the lateral mounting of disc valves.

Because the control parts are provided with two annular channels adjacent to the sliding surfaces, one of which channels is always connected to high pressure, the impression might arise that the channel under pressure is acting as a hydrostatic bearing. However, this is not the case because the annular channel does not give rise to any bearing rigidity desired for hydrostatic bearings. Such an annular channel around a cylinder lateral surface on no account results in a load-related radial deviation of the cylinder lateral surface relative to this surrounding surface.

In the case of disc valves too, the annular channel under pressure cannot perform the function of an axial hydrostatic bearing. Because it is connected to onward-conveying lines for feeding the displacer part, the decrease in the distance between the sliding surfaces does not lead to restoring pressure increases in the channel. In the case of a hydrostatic bearing having a pocket, the bearing fluid can emerge only through the outlet gap, so that a reduction in the size of the outlet gap leads to a pressure increase in the pocket and hence to restoring forces.

The use of pockets is particularly advantageous for hydrostatic mounting. In the case of radial bearings, good bearing rigidity or oil film rigidity is achieved radially in all directions through at least three pockets distributed essentially uniformly along a circle. The tilt resistance of an axial bearing is achieved by two sets of pockets a distance apart in the axial direction, each set having at least three pockets. In the case of axial bearings, essentially isotropic mounting and hence tilt resistance are achieved by at least three pockets distributed essentially uniformly along a circle. By providing hydrostatic bearings on both sides of a disc valve, this is also stabilized in the axial direction.

In a second inventive step, it is recognized that the working pressure of the planetary rotation machine should preferably be used for feeding the hydrostatic bearing. Then, working fluid is used as bearing fluid. At increased working pressure, an increased bearing pressure is thus also automatically established, resulting in the rigidity and restoring force to the central position of the bearing of the control part increasing with the working pressure and hence with the rotary valve load.

Thus, the operational relative eccentric displacement of the rotary valve remains the same and can also be calculated. "Relative displacement" means that the percentage change in the lubricating film between the rotary valve and the housing always remains the same regardless of the level of the working pressure of the machine. Wall contact is therefore always ruled out.

The advantages of such a bearing for the rotary valve are considerable. Since the speed of most planetary rotation machines is relatively low, the Newtonian shear stress in the oil film and hence the friction between rotary valve and housing is also extremely low. This is important in particular for good start-up efficiency. During rotation, only viscosity-related friction occurs, but no Coulomb friction. With simultaneously good cooling of the sliding surfaces, no wear occurs, owing to the continuous oil flow with a defined oil gap. The hydrostatic bearing also operates at low supply pressure, so that, even with moment-free high idling speed, the inlet dynamic pressure ensures freedom from friction in the bearing. Since, especially in the case of a disc valve, the usual compensation piston with its initial spring is dispensed with, the starting friction and the friction at high speed with their dynamic pressure become virtually zero. Since the oil gaps are only a few $\mu$m thick with exact manufacture in the case of such hydrostatic mounting, the oil throughputs through the bearing are extremely small and are scarcely measurable. Moreover, the oil throughput may also be influenced by the dimensioning of the pocket web widths.

A pressure potential around the mean bearing pressure is preferably made accessible for supplying the hydrostatic bearing. For this purpose, the supply line with a choke valve, the bearing gap and the effective bearing surface of the pocket are dimensioned so that the average bearing pressure is approximately in the range from ¼ to ¾, but preferably from ⅓ to ⅔, in particular essentially ½, of the supply pressure. When the supply is at the working pressure of the planetary rotation machine, the supply pressure corresponds to the working pressure or to the drive high pressure. The calculation for the hydrostatic bearing is carried out extremely reliably according to the Hagen-Poiseuille law, assuming laminar flow. Since both hydraulic resistances, namely that of the choke valve as well as that of the pocket outflow webs or outlet gaps, show the same linear relationship to the viscosity, the bearing functions at any operating viscosity and hence at any operating temperature.

The use of the pressure potential has the advantage that pressure adjustments diametrically opposed in opposite pockets occur in the case of a load-related deflection of the bearing from its central position. The pressure increases in one pocket owing to the smaller bearing gap and correspondingly decreases in the opposite pocket owing to the larger bearing gap. Such pressure differences in the pockets lead to restoration of the bearing to the central position.

To ensure that sufficient pockets are subjected to pressure in both directions of rotation when the pockets are supplied with working fluid from the planetary rotation machine, two sets of pockets are preferably provided, one of which is connected to the high-pressure spaces of the planetary rotation machine and the other to the low-pressure spaces of said machine in both directions of rotation. Embodiments according to the invention and in which the control part is hydrostatically mounted by means of working fluid can be realized with little constructional effort. In particular, the constructional measures can be limited to the control part, so that planetary rotation machines according to the prior art can also be converted into machines according to the invention by replacing the control part.

Since, owing to a simple internal bearing, most disc valves have no radially outer bearing surface, or at least no highly precise radially outer bearing surface, they can be produced by means of powder metallurgical methods without machining of the cylinder surface. The external shape with the channels connecting to the sliding surfaces, the port regions of the connections and the pockets is achieved by sintering and subsequent surface grinding of the lateral surfaces. The connections leading through the disc valve must be drilled, and the choke valves are preferably in the form of channels of small cross-section and are incorporated in the sliding surfaces in particular by electrical discharge machining. The spool valves will have to be produced with considerably greater machining effort and are thus too expensive in comparison with the disc valves in the manufacture of economical planetary rotation machines.

In the case of planetary rotation machines having a low working pressure or high pressure, in particular in the case of machines operated with compressed air, it may be necessary to use a bearing pressure which is greater than the working pressure. In this case, a separate pressure feed to the pockets must be provided. Accordingly, it is necessary in particular to achieve as good separation as possible of the bearing fluid from the working fluid. The cost of separate transport of the bearing fluid is very high and is therefore worthwhile only for very special applications.

BRIEF DESCRIPTION OF THE DRAWINGS

Specific embodiments of the invention will now be described, taken together with the drawings in which:

FIG. 2: Longitudinal section through a planetary rotation machine with disc valve FIG. 3*a*)=a view of a first lateral surface of a disc valve of the planetary rotation machine according to FIG. 2

FIG. 3*b*)=a longitudinal section in a first plane along section lines 3*b*—3*b* shown in FIG. 3*a*

FIG. 3*c*)=a view of a second lateral surface

FIG. 3*d*)=a longitudinal section in a second plane along section lines 3*d*—3*d* shown in FIG. 3*c*

DETAILED DESCRIPTION OF PREFERRED EMBODIMENT

Figure 1B:
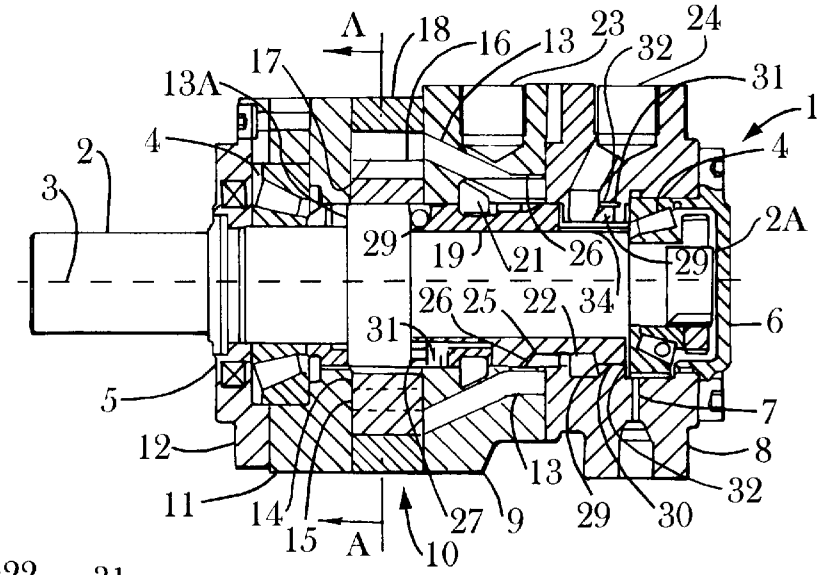
FIG. 1*a*)=a cross-section along section lines 1*a*—1*a* in FIG. 1*b* through the displacer part of a planetary rotation machine having a spool valve, FIG. 1*b*)=a longitudinal section FIG. 1*c*)=a longitudinal section through the spool valve, and FIG. 1*d*)=a view of the spool valve with pockets

FIG. 1*b*) shows a planetary rotation machine 1 having a drive shaft or power output shaft 2 which is mounted by means of two tapered roller bearings 4 at both end regions of the machine and is rotatable about a shaft axis 3. At the output end of the shaft 2, the machine 1 is sealed against leaks to the outside by means of a packing ring 5. The machine is tightly closed with a cover 6 at the shaft end 2*a* arranged in the machine 1. Oil leakage pipes are preferably provided for pressure relief of the packing 5. An oil leakage pipe 7 is shown, for example, in a first housing part 8 adjacent to the cover 6. If necessary, the oil leakage line 7 is also connected via a non-return valve to the low-pressure side of the working fluid system. Connecting lines 13 which connect with the displacer part 10 are provided in a second housing part or connecting part 9 adjacent to the first housing part 8. A third housing part 11 and a terminating part 12 holding the sealing means 5 are arranged between the displacer part 10 and the packing ring 5.

The shaft 2 is provided, in the region of the displacer part 10, with an external tooth system 13A which intermeshes with the internal tooth system 14 of the rotary piston. The rotary piston 14 revolves eccentrically around the shaft 2 and, by means of an outer tooth system 16, intermeshes with an inner tooth system 17 of the displacer housing part 18.

Figure 1D:
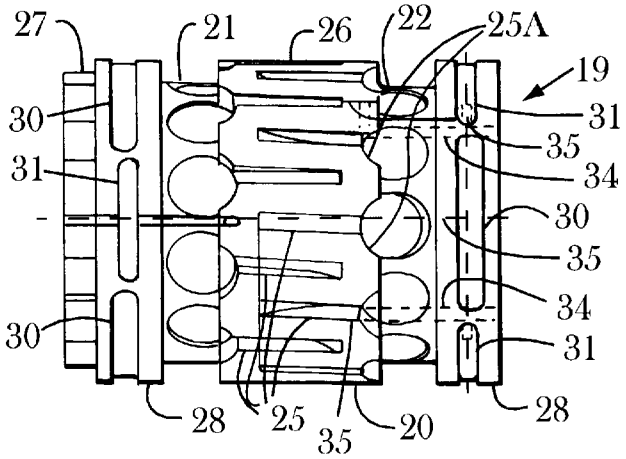
Figure 1A:
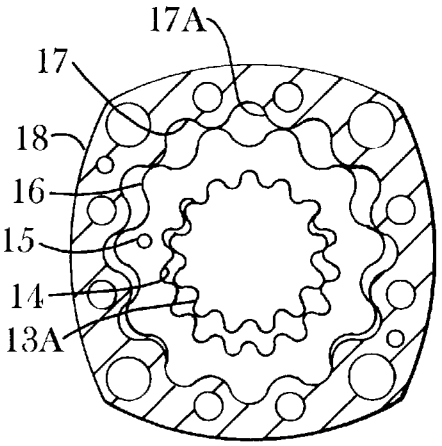

FIG. 1*a*) shows the displacer part 10 in cross-section and thus gives a good insight into the tooth system described. In order to rotate the shaft 9 in the clockwise direction during motor operation, the left half of the working space situated between the displacer housing part 18 and the rotary piston 15 must be connected to working fluid under high pressure, and the right half simultaneously to low pressure. The connecting lines 13 leading into the displacer part 10 or into the working space enter between the teeth 17*a* of the inner tooth system 17. In the embodiment shown and having the twelve teeth 17*a*, twelve connecting lines 13 are thus provided. As seen in FIG. 1*a*), practical teeth arrangements for the planetary rotation machine can be: twelve teeth 17; eleven teeth 16; fifteen teeth 14; and thirteen teeth 13A.

To ensure the hemispherical feed rotating simultaneously with the rotary piston 15, a control part 19 rotatable around the shaft axis 3 and mounted in the first housing part 8 and in the connecting part 9 is provided in accordance with FIGS. 1*b*), *c*) and *d*). The control part 19 is in form of a cylindrical spool valve and comprises two annular channels 21 and 22 in its cylindrical outer surface 20, which channels are open to the outside. The high-pressure side of the two working fluid connections 23 and 24 is connected to one channel 21, and the low-pressure side to the other channel. In the control part 19, connections 25 extend alternately from the two annular channels 21 and 22 into a common connection region 26, from which the connection lines 13 lead through the connection part 9 to the displacer part 10. In the embodiment shown, eleven connections 25 connect to each of the two channels 21 and 22. The necessary hemispherical feed of the displacer part results from the contacts between the twenty two connections 25 alternately connected to high and low pressure and the twelve connecting lines 13, said contacts changing with the rotation of the control part 19.

Tests have shown that the design of the branching regions of the channels 21 and 22 from which the connections 25 emanate have a major influence on the flow resistance of the spool valve. Sharp edges produce turbulence in the working medium, so that the flow resistance observed is substantially higher than in the case of chamfered branches 25*a*, as shown in FIG. 1*d*). Chamfering was achieved by bores in these port regions.

In order to rotate the control part 9 synchronously with the rotary piston, said part has, at its end facing the displacer part 10, an outer tooth system 27 which intermeshes with the inner tooth system 14 of the rotary piston 15. In that the two tooth systems 27 and 14 have the same number of teeth, it is ensured that they rotate at the same speed about their axes of rotation.

Narrow cylindrical first sliding surfaces 28 are mounted at the two end regions of the control part 19 and are required for radial outer mounting of the control part on second sliding surfaces 29 of the parts 8 and 9 connected as bearing parts to the control part. In order to generate a hydrostatic bearing between these first and second sliding surfaces 28 and 29, three first and three second pockets 30 and 31 in the form of indentations are preferably arranged in the sliding surfaces 28 of the control part 19. In order to achieve as uniform mounting as possible, the pockets 30 and 31 are arranged symmetrically with respect to rotation through 120° about the shaft axis. Outlet gaps 32 are formed between the second sliding surface 29 and the pocket edges in the first sliding surface 28.

The three first pockets 30 are each connected to the nearest channel 21 or 22 via a choke line 35 or a groove having an extremely small cross-section. In the case of a centrally located control part 19, the choke lines 35 and the outlet gaps 32 are dimensioned so that about half the high pressure builds up in the pocket 30 when high pressure prevails in channel 21 or 22, to which the choke line 35 leads.

The choke lines or choke channels have a depth which is at least five times, more expediently not more than ten times, but preferably essentially six times, as large as the average bearing gap width or as the optimum distance between the sliding surfaces. The width of the choke lines is calculated so that the desired pressure, in particular about half of high pressure, is achieved in the pocket. According to one embodiment, the bearing gap is 5 $\mu$m, the depth of the choke channel is 30 $\mu$m and the width is 200 $\mu$m.

In that the channel depth is chosen substantially larger than the bearing gap width, a change in the bearing gap has only an insignificant effect on the cross-section of the choke line. A solution in which this cross-section remains constant even in the event of changes in the bearing gap would be preferable. However, such solutions entail excessively high manufacturing cost.

Figure 1C:
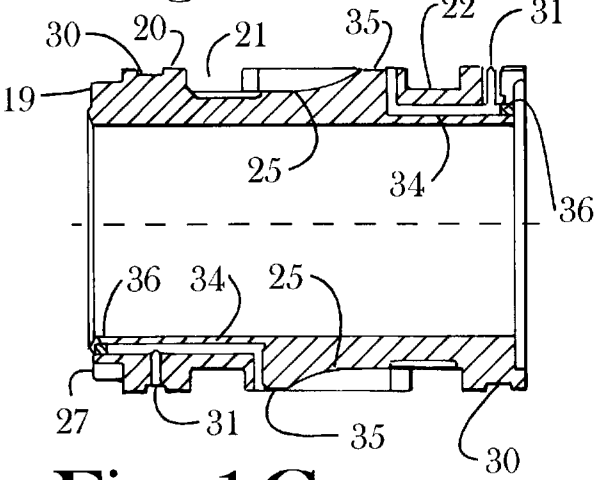

Since the high pressure is built up either in channel 21 or channel 22, depending on the direction of rotation, pockets 30, 31 must be fed from both channels 21, 22 so that the hydrostatic mounting is ensured in both directions of rotation. For this purpose, pockets 31 are connected via supply lines 34 and choke valves 35 to connections 25, which lead to the more remote channel 21, 22 (FIG. 1*c*). In the control part 19, the supply lines 34 each pass below the nearest channel 21, 22 and furthermore comprise one axial and two radial bores. The axial bore made from the end face of the control part is closed with a terminating part 36 in the region of the end face, so that the u-shaped supply line 34 does not leak.

The pockets 30 and 31 arranged adjacent to one another are connected alternately to the channel 21 and to the channel 22. Since one of the two channels always carries working fluid under high pressure in both directions of rotation, a pocket set comprising three pockets 30 or 31 is always supplied with working fluid under pressure in both end regions of the control part. The working and bearing fluid emerging through the bearing gaps is removed from the machine by means of oil leakage lines 7.

FIG. 2 shows an embodiment having a disc-like control part 19'. This disc valve 19' comprises an annular channel 21 mounted on the cylinder surface and extending to a first lateral surface 37, and an annular channel 22 connecting to the first lateral surface. Connecting bores 25 run alternately from the channels 21 and 22 to a second lateral surface 38 and to the circular port region 26 where they may connect with connecting lines 13. The disc valve 19' is rotated by a driver sleeve 39 at the speed of the rotary piston. For this purpose, the driver sleeve 39 has an outer tooth system 27' intermeshing with the inner tooth system of the rotary piston arranged in the displacer part 10, and a contact end 40 in contact with the disc valve 19'.

The disc valve 19' is hydrostatically mounted between the bearing parts 8 and 9 connecting to the lateral surfaces 37 and 38. For this purpose, pockets 130 and 131 are formed in the first lateral surface 37, and pockets 230 and 231 in the second lateral surface 38. The pockets 130 and 230, and 131 and 231, are connected to the channels 22 and 21, respectively, via connections having grooves 35 which are formed as choke valves and are present in the lateral surfaces 37, 38.

According to FIG. 3*c*), three pockets 230 and 231 are arranged in the second lateral surface 38 symmetrically at 120° intervals along a concentric circle. The choke valves 35 connect the pockets 230 and 231 directly to the connecting bores 25 which are connected to the channels 22 and 21, respectively. From three connecting bores 25 connected to the channel 21, choke valves 35' lead to supply bores 34' which, according to FIG. 1*d*), are formed from the second lateral surface 38 through the disc valve 19' to pockets 131 of the first lateral surface 37.

According to FIG. 3*a*), the pockets 130, 131 of the first lateral surface 37 are arranged, with respect to the axis of rotation 3, identically to the pockets 230, 231 of the second lateral surface 38. In the pockets 131, the supply bores 34' are evident.

The pockets 130 are fed from the channel 22 which surrounds them. A part of the leakage stream from the channel 22 also reaches the pockets 130, which prevents or reduces the pressure build up required for restoration when the outlet gap of the pockets 130 is increased in size. In order to reduce the action of the leakage stream on the pockets 130, the radial distance between the channel 22 and the pockets 130 is preferably made as large as possible. If necessary, a separating groove connected to the low pressure is provided between the channel 22 and the pockets 130. The choke valves 35 between the channel 22 and the pockets 130 must be dispensed with. Corresponding to the supply to the pockets 131, the supply must be effected from the second lateral surface 38.

If, in the embodiment according to FIGS. 2 and 3, the two lateral surfaces 37, 38 are hydrostatically mounted and connect with an extremely small separation gap with the parts 8 and 9 surrounding the disc valve 19', no significant leakage losses can occur even from the cylindrical outer surface or from the channel 21. This means that radial hydrostatic mounting is not necessary.

To ensure that no forces or only small forces which emanate from the channel 21 or 22 subjected to pressure and the ports of the connections 25 are superposed on the hydrostatic bearing, the total areas subjected to pressure on both lateral surfaces of the disc valve are made essentially the same size. The resulting residual force must be at least smaller than the restoring forces emanating from the hydrostatic bearing.

Figure 4:
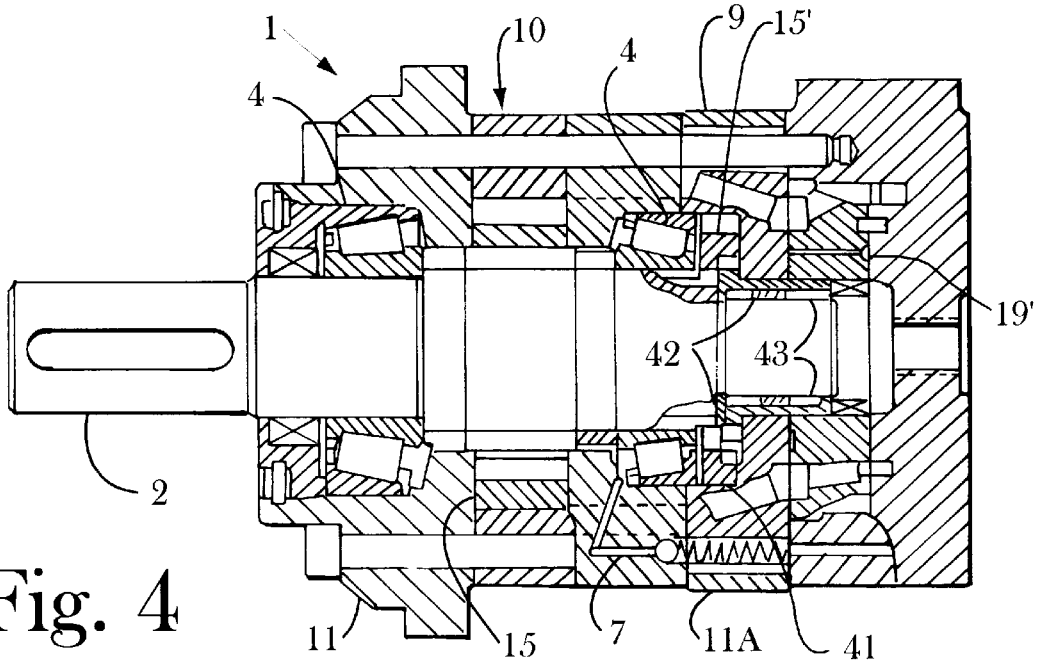
FIG. 4: Longitudinal section through a planetary rotation machine having an auxiliary gear between the shaft and disc valve

FIG. 4 shows an embodiment in which the bearings 4 of the shaft 2 are arranged directly on either side of the displacer part 10. For this purpose, a further housing part 11*a* which holds the other bearing 4 is provided next to the third housing part 11 in which one bearing 4 is arranged. By means of this further housing part 11*a* and the bearing 4, direct transmission of the rotary piston revolution to the control part 19' is no longer possible. The control part 19' is rotated via an auxiliary gear 41 by rotation of the shaft 2. However, since the shaft 2 has a tooth difference with respect to the rotary piston 15 and it does not rotate at the speed of the rotary piston 15, the auxiliary gear 41 must generate a transmission which compensates the transmission in the transfer of rotation from the rotary piston 15 to the shaft 2 and thus drives the control part 19' at the same speed as the rotary piston 15.

The auxiliary gear 41 is preferably in the form of a rotary piston gear and designed essentially in the same way as the gear of the displacer part 10. An outer tooth system of the shaft 2 intermeshes with an inner tooth system of a gear piston 15', and an outer tooth system of the piston 15' with an inner tooth system of the connecting part 9. With the use of the same number of teeth as in the displacer part 10, the gear piston 15' rotates at the same speed as the rotary piston 15 of the displacer part 11. The rotation of the gear piston 15' is taken up at the same speed by a transmission sleeve 42 having an outer tooth system which engages the inner tooth system of the gear piston 15'. The disc valve 19' rests firmly on the transmission sleeve 42 and thus rotates at the same speed as the two pistons 15 and 15'.

The embodiment according to FIG. 4 has several advantages. It permits mounting of the shaft 2 directly at both sides of the displacer part 10. Furthermore, the shaft tooth system 13 may be identical or even broader than the rotor tooth system 14, so that an increase in the tooth strength of the shaft 2 is achieved. The displacer part 10 and the control part 19' are arranged spatially separately and, if required, may be opened or removed independently of one another. As a result of the optimum bearing arrangement for the shaft 2, the shaft end coordinated with the control part 19' rotates essentially concentrically, so that a needle bearing 43 arranged around the shaft 2 can be used for radial mounting of the transmission sleeve 42 and hence of the disc valve 19'. The axial mounting of the control part 19' is hydrostatic. For this purpose, the control part 19' is formed according to FIG. 3. Owing to the axial hydrostatic bearing and the radial needle bearing, the control part 19' rotates with extremely little frictional loss.

Figure 5:
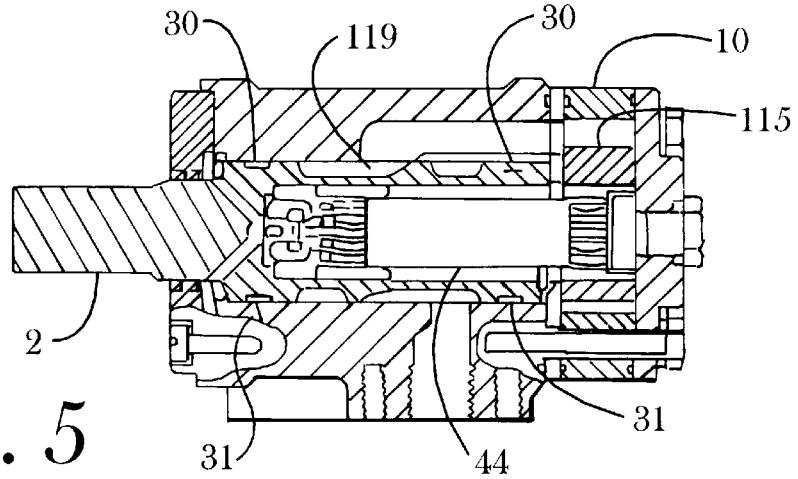
FIG. 5: Longitudinal section through a planetary rotation machine of older design, having a control part which is integral with the shaft

The hydrostatic mounting, according to the invention, of the control part can also be applied according to FIG. 5 if the control part 119 is firmly connected to, in particular formed integrally with, the drive shaft or power take-off shaft rotating synchronously with the rotary piston. The hydrostatic bearing comprises pockets 30 and 31 which are arranged at least in the two cylindrical end regions of the control part 119. Owing to the connection between shaft 2 and control part 119, the hydrostatic bearing acts as a shaft bearing. In the embodiment shown, a Cardan shaft 44 is arranged, for transmission of rotation, between the displacer part 10 or the rotary piston 115 and the shaft 2, said Cardan shaft being connected nonrotatably via tooth systems at both ends to the adjacent parts. Control part 119 is essentially of the same construction as the control part according to FIG. 1*d*), but the tooth system 27 is not required because the control part 119 is formed integrally with the shaft 2. The hydrostatic bearing substantially increases the efficiency of the machine compared with embodiments without hydrostatic bearings.

Figure 6:
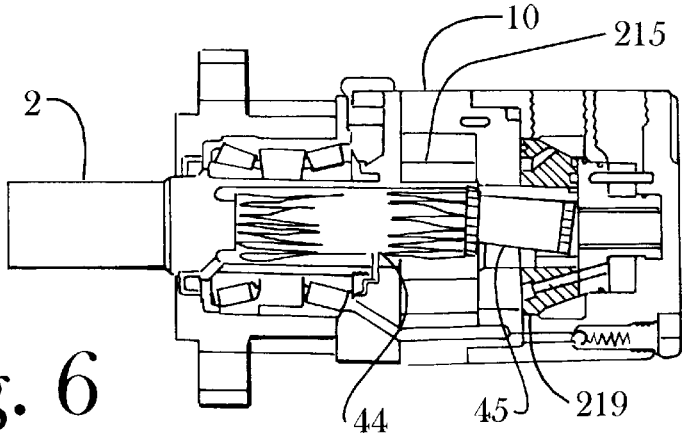
FIG. 6: Longitudinal section through a planetary rotation machine of older design, having a Cardan shaft between the rotary piston and the control part

FIG. 6 shows an embodiment in which the shaft 2, via a first Cardan shaft 44, and the control part 219, via a second Cardan shaft 45, are driven at the same speed by the displacer part 10 and by the rotary piston 215, respectively. The control part is designed according to FIG. 3 and is thus hydrostatically mounted.

The embodiments described show that the hydrostatic mounting of the control part is possible and advantageous in all planetary rotation machines having a rotating control part. Of course, all features of the embodiments described may be combined as desired.

I claim:

1. A planetary rotation machine comprising:

a displacer part (10) acting as a drive part or power take-off part, a control part (19, 19', 119, 219) which serves for supplying working fluid to, and removing working fluid from, the displacer part (10) and rotates relative to at least one adjacent bearing part (8, 9, 11*a*) about an axis of rotation of the control part, the displacer part (10) having a stationary outer part (18) with an inner tooth system (17) which interacts with an outer tooth system (16) of a rotatable, eccentrically arranged rotary piston (15), transmission means (13A, 14, 44) which transmits the rotary velocity of the rotary system (15) about its own axis with the same torque to the drive part or power take-off part (2), and a hydrostatic bearing between the control part (19, 19', 119, 219) and at least one stationary adjustment bearing part (8, 9, 11*a*), sliding thereon at least in one region.

2. The planetary rotation machine according to claim 1, further comprising means for achieving a high oil film rigidity, the oil pressure changing as a function of the bearing state.

3. A planetary rotation machine comprising:

a displacer part (10) acting as a drive part or power take-off part, a control part (19, 19', 119, 219) which serves for supplying working fluid to, and removing working fluid from, the displacer part (10) and rotates relative to at least one adjacent bearing part (8, 9, 11*a*) about an axis of rotation of the control part, the displacer part (10) having a stationary outer part (18) with an inner tooth system (17) which interacts with an outer tooth system (16) of a rotatable, eccentrically arranged rotary piston (15), transmission means (13A, 14, 44) which transmits the rotary velocity of the rotary piston (15) about its own axis with the same torque to the drive part or power take-off part (2), and a hydrostatic bearing between the control part (19, 19', 119, 219) and at least one stationary adjacent bearing part (8, 9, 11*a*), sliding thereon at least in one region wherein for receiving bearing fluid the hydrostatic bearing comprises:

two sets of pockets (30, 31, 130, 131, 230, 231) in the control part and in one or more bearing parts (8, 9, 11*a*), which pockets are surrounded by an outlet gap between the control part and a bearing part and can be fed with bearing fluid under pressure via a supply line (34, 35), one of which sets of pockets is connected to high pressure spaces or channels (21, 22, 25) and one of which sets of pockets is connected to low pressure spaces or channels in an operating state in both directions of rotation.

4. A planetary rotation machine comprising:

a displacer part (10) acting as a drive part or power take-off part, a control part (19, 19', 119, 219) which serves for supplying working fluid to, and removing working fluid from, the displacer part (10) and rotates relative to at least one adjacent bearing part (8, 9, 11*a*) about an axis of rotation of the control part, the displacer part (10) having a stationary outer part (18) with an inner tooth system (17) which interacts with an outer tooth system (16) of a rotatable, eccentrically arranged rotary piston (15), transmission means (13A, 14, 44) which transmits the rotary velocity of the rotary piston (15) about its own axis with the same torque to the drive part or power take-off part (2), and a hydrostatic bearing between the control part (19, 19', 119, 219) and at least one stationary adjacent bearing part (8, 9, 11*a*), sliding thereon at least in one region wherein for receiving bearing fluid the hydrostatic bearing comprises at least one pocket (30, 31, 130, 131, 230, 231) in the control part and in one or more bearing parts (8, 9, 11*a*), which pocket is surrounded by an outlet gap between the control part and a bearing part and can be fed with bearing fluid under pressure via a supply line (34, 35), and wherein a choke valve (35) and an outlet gap of each pocket (30, 31, 130, 131, 230, 231), with constant bearing gap thickness in the entire bearing region, are dimensioned so that on connection to high pressure in a relevant pocket, a pressure in the range from ¼ to ¾ of the high pressure prevails, and in the event of a load-dependent decrease or increase in the size of an outlet gap from this relevant pocket to the low pressure, the pressure in the pocket increases or decreases respectively, and an optimal oil film rigidity of the hydrostatic bearing occurs as a result of a pressure potential between opposite pockets.

5. The planetary rotation machine according to claim 4, wherein the pressure is in the range of ⅓ to ⅔ of the high pressure.

6. The planetary rotation machine according to claim 5, wherein the pressure is in the range of ½ of the high pressure.

7. A planetary rotation machine comprising:

a displacer part (10) acting as a drive part or power take-off part (2), a control part (19, 19', 119, 219) which serves for supplying working fluid to, and removing working fluid from, the displacer part (10) and rotates relative to at least one adjacent bearing part (8, 9, 11*a*) about an axis of rotation of the control part, the displacer part (10) having a stationary outer part (18) with an inner tooth system (17) which interacts with an outer tooth system (16) of a rotatable, eccentrically arranged rotary piston (15), transmission means (13A, 14, 44) which transmits the rotary velocity of the rotary piston (15) about its own axis with the same torque to the drive part or power take-off part (2), and a hydrostatic bearing between the control part (19, 19', 119, 219) and at least one stationary adjacent bearing part (8, 9, 11*a*), sliding thereon at least in one region, wherein for receiving bearing fluid the hydrostatic bearing comprises at least two sets of pockets (30, 31, 130, 131, 230, 231) in the control part and in one or more bearing parts (8, 9, 11*a*), which pockets are surrounded by an outlet gap between the control part and a bearing part and can be fed with bearing fluid under pressure via a supply line (34, 35), and wherein each of the sets of pockets comprises at least one pair of pockets, one set of pockets being connected to high pressure spaces or channels (21, 22, 25) and one set of pockets being connected to low pressure spaces or channels in an operating state in both directions of rotation.

8. A planetary rotation machine according to claim 7, wherein each of the two sets of pockets comprise three pockets.

9. The planetary rotation machine according to claim 7, comprising at least one of the following features:

a) in a radial hydrostatic bearing, the outflow gap from the pockets is in the range from 0.25 to 0.35 per mil of the diameter of the hydrostatic bearing;

b) in the case of an axial hydrostatic bearing, the gap width of the outflow gap from the pockets is in the range of from 0.4 to 1.0 per mil of the axial thickness of the control part;

c) in the case of an axial hydrostatic bearing, the gap width of the outflow gap from the pockets is in the range of from 0.6 to 0.8 per mil of the axial thickness of the control part.

10. The planetary rotation machine according to claim 7, wherein the outer part (18) of the displacer part (10) is in the form of a fixed housing part, and the rotary piston (15) has a second inner tooth system (14) which intermeshes with a second outer tooth system (13A) on a concentric shaft (2) if the latter passes at least partly through the control part, the difference in the number of teeth between the first inner and outer tooth systems being 1, and the difference in the number of teeth between the second inner and outer tooth systems being at least 2.

11. A planetary rotation machine comprising:

a displacer part (10) acting as a drive part or power take-off part, a control part (19, 19', 119, 219) which serves for supplying working fluid to, and removing working fluid from, the displacer part (10) and rotates relative to at least one adjacent bearing part (8, 9, 11*a*) about an axis of rotation of the control part, the displacer part (10) having a stationary outer part (18) with an inner tooth system (17) which interacts with an outer tooth system (16) of a rotatable, eccentrically arranged rotary piston (15), transmission means (13A, 14, 44) which transmits the rotary velocity of the rotary piston (15) about its own axis with the same torque to the drive part or power take-off part, and a hydrostatic bearing between the control part (19, 19', 119, 219) and at least one stationary adjacent bearing part (8, 9, 11*a*), sliding thereon at least in one region, and two sets of pockets, at least one of which sets is connected to high pressure spaces (21, 22, 25) and at least one of which sets is connected to low pressure spaces (21, 22, 25) in both directions of rotation.

* * * * *